US008272765B2

(12) United States Patent
Ter-Hovhannisyan

(10) Patent No.: US 8,272,765 B2
(45) Date of Patent: Sep. 25, 2012

(54) HEAT SINK SYSTEM

(75) Inventor: Zorak Ter-Hovhannisyan, Burbank, CA (US)

(73) Assignee: Light Emitting Design, Inc., Burbank, CA (US)

( * ) Notice: Subject to any disclaimer, the term of this patent is extended or adjusted under 35 U.S.C. 154(b) by 239 days.

(21) Appl. No.: 12/819,572

(22) Filed: Jun. 21, 2010

(65) Prior Publication Data

US 2011/0309751 A1 Dec. 22, 2011

(51) Int. Cl.
*F21V 29/00* (2006.01)

(52) U.S. Cl. ..... 362/294; 362/373

(58) Field of Classification Search ..... 362/294, 362/373

See application file for complete search history.

(56) References Cited

U.S. PATENT DOCUMENTS

| | | | | |
|---|---|---|---|---|
| 8,125,125 | B2 * | 2/2012 | Liu et al. | 313/46 |
| 2003/0230765 | A1 * | 12/2003 | Dry | 257/200 |
| 2010/0102694 | A1 * | 4/2010 | Shin | 313/1 |
| 2010/0296272 | A1 * | 11/2010 | Roos et al. | 362/147 |
| 2011/0025211 | A1 * | 2/2011 | Bae | 315/113 |
| 2011/0050070 | A1 * | 3/2011 | Pickard | 313/46 |
| 2011/0260599 | A1 * | 10/2011 | Qiu | 313/46 |

* cited by examiner

*Primary Examiner* — Evan Dzierzynski
(74) *Attorney, Agent, or Firm* — Kelly & Kelley, LLP

(57) ABSTRACT

The improved heat sink system for a lighting fixture includes a conductive mount configured to selectively receive and retain a lighting subassembly. An inner heat sink couples to the conductive mount and is positioned to encompass the lighting assembly. A plurality of cooling fins couple to and extend away from the inner heat sink. An outer heat sink couples to the cooling fins and is offset from the inner heat sink to permit air flow therebetween and over the cooling fins. This enables air convection cooling of the inner heat sink, the outer heat sink and the cooling fins simultaneously to draw heat energy away from the lighting subassembly.

17 Claims, 8 Drawing Sheets

HEAT SINK SYSTEM

BACKGROUND OF THE INVENTION

The present invention relates to an improved heat sink system. More particularly, the invention relates to an improved heat sink system having an inner heat sink coupled to a plurality of outwardly extending cooling fins encased by an outer heat sink, thereby improving heat dissipation from a heat generating device by increasing the amount of heat sink surface area subject to air convection.

Heat sinks are components or assemblies designed to transfer energy away from a device generating heat. Oftentimes, heat sinks make use of a fluid medium such as water or air to facilitate heat exchange to the surrounding environment. Some examples of heat sinks used as a means for heat transfer include refrigeration systems, air conditioning systems, radiators, etc. Other types of heat sinks are used to cool electric devices, such as circuit boards, computer chips, diodes, and other higher powered optoelectronic devices such as lasers and light emitting diodes (LEDs).

Electronic devices typically have heat sinks that pass air over a heat dissipation surface directly coupled to the heat generation source. The heat dissipation area is designed to increase heat transfer away from the heat generating core, thereby cooling the electrical device. Heat transfer occurs mainly by way of convection. In computer chips, a highly conductive material having a fan thereon is typically mounted directly to the processor. The fan forces air over the conductive material to increase the rate of convection. Without the fan, convection would otherwise occur naturally because hotter air near the source would rise relative to denser, cooler air. For example, as a processor heats the surrounding air, the warmer and less-dense air rises away from the processor and is replaced by the denser, cooler air. In fact, the warmer air will continue to move away from the heat source until it reaches the ambient air temperature of the surrounding environment. The process continues as cooler air continually replaces upwardly rising warmer air.

Fans force convection by blowing air across a heated surface. This naturally results in increased cooling as cooler air forcefully enters the heated space and warmer air is forced out. Natural convection forces may still be present, but they are typically negligible in such an embodiment. Forced convection may remove more heat than natural convection, but forced convection carries several drawbacks. For instance, forced convection requires a device, such as a fan, to move the air. In small electronic packages or where it is desirable to minimize the amount of energy expended to cool the electronic components, forced convection may be undesirable. Moreover, reliance on the fans can be detrimental to the operation of the device should the fan become nonoperational. In some circumstances replacing a nonfunctioning fan could be a maintenance problem. Thus, to save time, energy and labor costs required to operate and maintain such devices, it is generally desirable to eliminate the fan from the heat sink, if possible.

For lighting applications, LEDs are particularly energy efficient and tend to have a long operating life. LEDs may be employed in many different basic lighting structures to replace conventional neon or fluorescent lighting. More specifically, LED lighting assemblies may be deployed as street lights, automotive headlights or taillights, traffic and/or railroad signals, advertising signs, etc. These assemblies are typically exposed to natural environmental conditions and may be exposed to high ambient operating temperatures—especially during the daytime, in warmer climates and in the summer. When coupled with the self-generated heat of the LEDs in the assembly, the resulting temperature within the assembly may affect LED performance. In fact, LED performance tends to substantially degrade at higher operating temperatures because LEDs have a negative temperature coefficient of light emission. That is, LED illumination decreases as the ambient temperature rises. For example, LED light intensity is halved at an ambient temperature of 80° Celsius ("C.") compared to 25° C. This naturally shortens the lifespan of the LED and reduces light output. These adverse operating conditions can have safety implications depending on the application. Thus, the LED temperature should be kept low to maintain high illumination efficiency.

Heat sink design considerations, therefore, have become increasingly important as LEDs are used in more powerful lighting assemblies that produce more heat energy. Heat dissipated in conventional LED assemblies has reached a critical level such that more intricate heat dissipation designs are needed to better regulate the self-generated heat within the LED assembly. The increased heat within the assemblies is mainly caused by substantially increasing the device drive current to achieve higher luminous output from the LEDs. Preferably, the internal temperature of the lamp assembly is maintained somewhat below the maximum operating temperature so the electrical components therein maintain peak performance. It is advantageous to design an assembly with a mechanism that continually cools the chamber and the LEDs located therein. Accordingly, there is a constant need for improved thermal management solutions for LED-based lighting systems.

There exists, therefore, a significant need for an improved heat sink system that improves the efficiency of dissipating heat away from a heat generating device. Such an improved heat sink system should include a conductive mount that selectively attaches to a heat generation device, an inner heat sink coupled to the conductive mount and configured to encompass the heat generation device, a plurality of cooling fins extending away from the inner heat sink and exposed to air flow, and an outer heat sink coupled to the plurality of cooling fins and having a surface area greater than the inner heat sink. Such an improved heat sink system should further include one or more vents positioned between the inner heat sink and the outer heat sink to improve air convection cooling adjacent to the inner heat sink, the cooling fins and the outer heat sink to improve heat dissipation away from the heat generation device. The present invention fulfills these needs and provides further related advantages.

SUMMARY OF THE INVENTION

The improved heat sink system for a lighting fixture generally includes a conductive mount configured to selectively receive and retain a lighting subassembly. In a preferred embodiment, a plurality of LEDs electrically couple to a PCB board attachable to the conductive mount as part of the lighting subassembly. Each LED is a high brightness LED chip surface mounted to the PCB board. An inner heat sink is coupled to the conductive mount and positioned to encompass the lighting assembly. A cap may couple to outer heat sink to environmentally encapsulate the lighting assembly. Preferably, the cap is a reflector that has a light dispersing lens with an optical diffuser surface area providing no-glare uniform lighting.

The heat sink system further includes a plurality of cooling fins coupled to and extending away from the inner heat sink. An outer heat sink coupled to the cooling fins is offset from the inner heat sink to permit air flow therebetween and over the cooling fins. This allows the heat sink system to cool the inner heat sink, the outer heat sink and the cooling fins via air convection. This effectively draws heat energy away from the lighting assembly to cool the LEDs and the PCB board. In turn, the LEDs last longer and are more luminous.

In one embodiment, the outer heat sink is formed from two components: a lower heat sink coupled to a first set of cooling fins mounted to the inner heat sink and an upper heat sink coupled to a second set of cooling fins offset from the first set of cooling fins. An air vent may extend through the outer heat sink to permit air flow adjacent to the cooling fins and the inner heat sink. This provides enhanced ventilation between the inner heat sink and the outer heat sink. Preferably, the conductive mount, the inner heat sink and the outer heat sink are made from a highly conductive alloy metal or die-cast material designed to dissipate heat energy. The surface area of the outer heat sink is relatively larger than the surface area of the inner heat sink due to the offset nature of the outer heat sink relative to the inner heat sink.

The improved heat sink system further includes several additional safety features designed to maintain max performance for the lighting fixture. For example, a safety circuit may couple to the lighting subassembly. Such a safety circuit preferably includes a temperature sensor, a voltage sensor or a current sensor. The safety circuit may further operate a kill switch that automatically activates when the temperature sensor determines that a threshold temperature has been exceeded, the voltage sensor determines that a threshold voltage has been exceeded, or the current sensor determines that a threshold current has been exceeded. The kill switch may, alternatively, decrease current output to the PCB board and/or the LEDs to reduce luminescent output rather than completely shutting down the lighting fixture to maintain the system within prescribed parameters.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
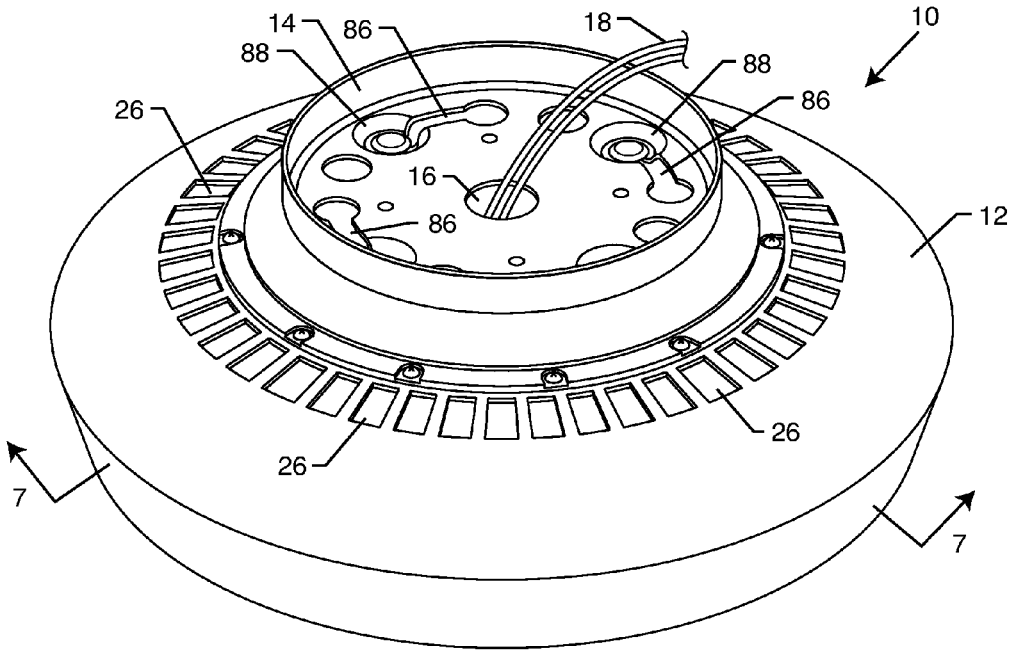
FIG. 1 is a top perspective view of an industrial light embodying the improved heat sink system.

As shown in the drawings for purposes of illustration, the present invention for an improved heat sink system is illustrated embodied in an industrial light, referred to generally by the reference number 10. In FIG. 1, the industrial light 10 is illustrated having an outer heat sink 12 coupled to a mounting bracket 14 through a snap and turn mounting system. The mounting bracket 14 includes a central aperture 16 providing access to the interior of the industrial light 10. As shown in FIG. 1, a pair of electrical wires 18 extend out from within the outer heat sink 12 and the mounting bracket 14 to provide electrical energy to a device located within the interior of the outer heat sink 12. Positioning the central aperture 16 to the interior of the mounting bracket 14 ensures that the industrial light 10 can be attached to the mounting bracket 14 via the aforementioned snap and turn mounting system without the electrical wires 18 binding, twisting or otherwise getting caught on components inside the outer heat sink 12 or the bracket 14. This feature is particularly ideal because the industrial light 10 can be engaged or disengaged from the mounting bracket 14 with ease. The features of the snap and turn mechanism are described in more detail below with respect to FIGS. 9-11.

Figure 2:
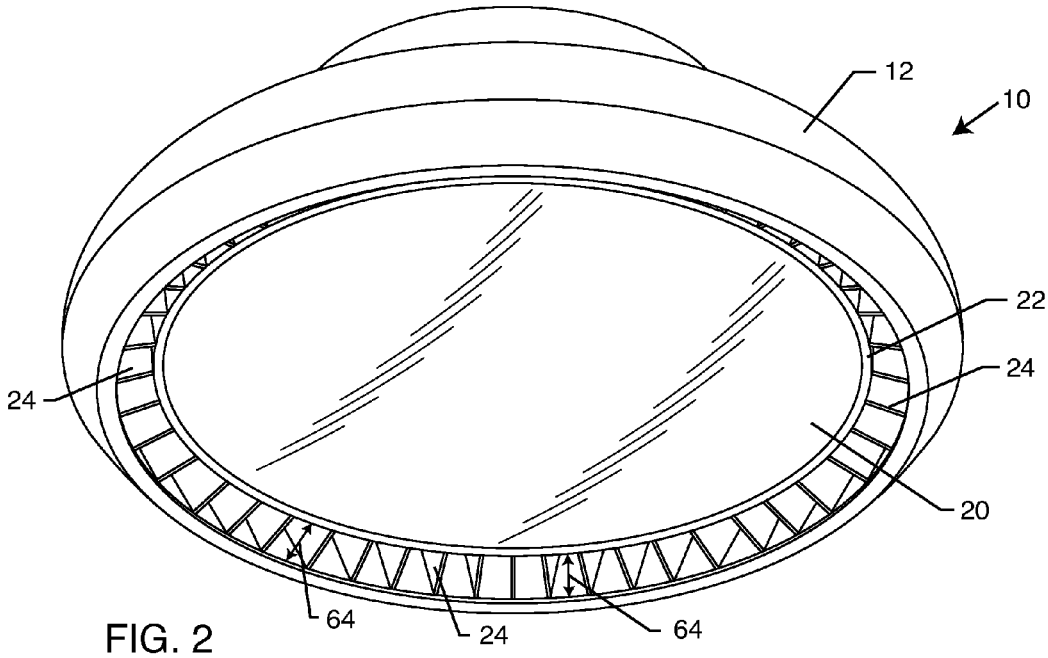
FIG. 2 is a bottom perspective view of the industrial light of FIG. 1.

FIG. 2 illustrates a bottom perspective view the industrial light 10. The industrial light 10 includes a light diffuser 20 coupled to an inner heat sink 22 to form an environmentally sealed chamber therein. FIG. 2 further illustrates a plurality of cooling fins 24 extending between the inner heat sink 22 and the outer heat sink 12. Preferably, the outer heat sink 12 is offset from the inner heat sink 22 by the width of the cooling fins 24 to maximize the amount of surface area of the inner heat sink 22, the outer heat sink 12 and the cooling fins 24 subject to air convection cooling. The area between the inner heat sink 22 and the outer heat sink 12 is primarily open to the environment to allow air flow therethrough. As shown in FIG. 1, the outer heat sink 12 includes a plurality of vents 26 that facilitate such air flow through the outer heat sink 12 and adjacent to the inner heat sink 22 and the cooling fins 24. These particular features, as illustrated in more detail below, enable the industrial light 10 to encapsulate and environmentally seal (e.g. water proof) the heat generating device therein while maximizing exposure of the respective surface areas of the inner heat sink 22, the cooling fins 24 and the outer heat sink 12 to facilitate air convection cooling.

Figure 3:
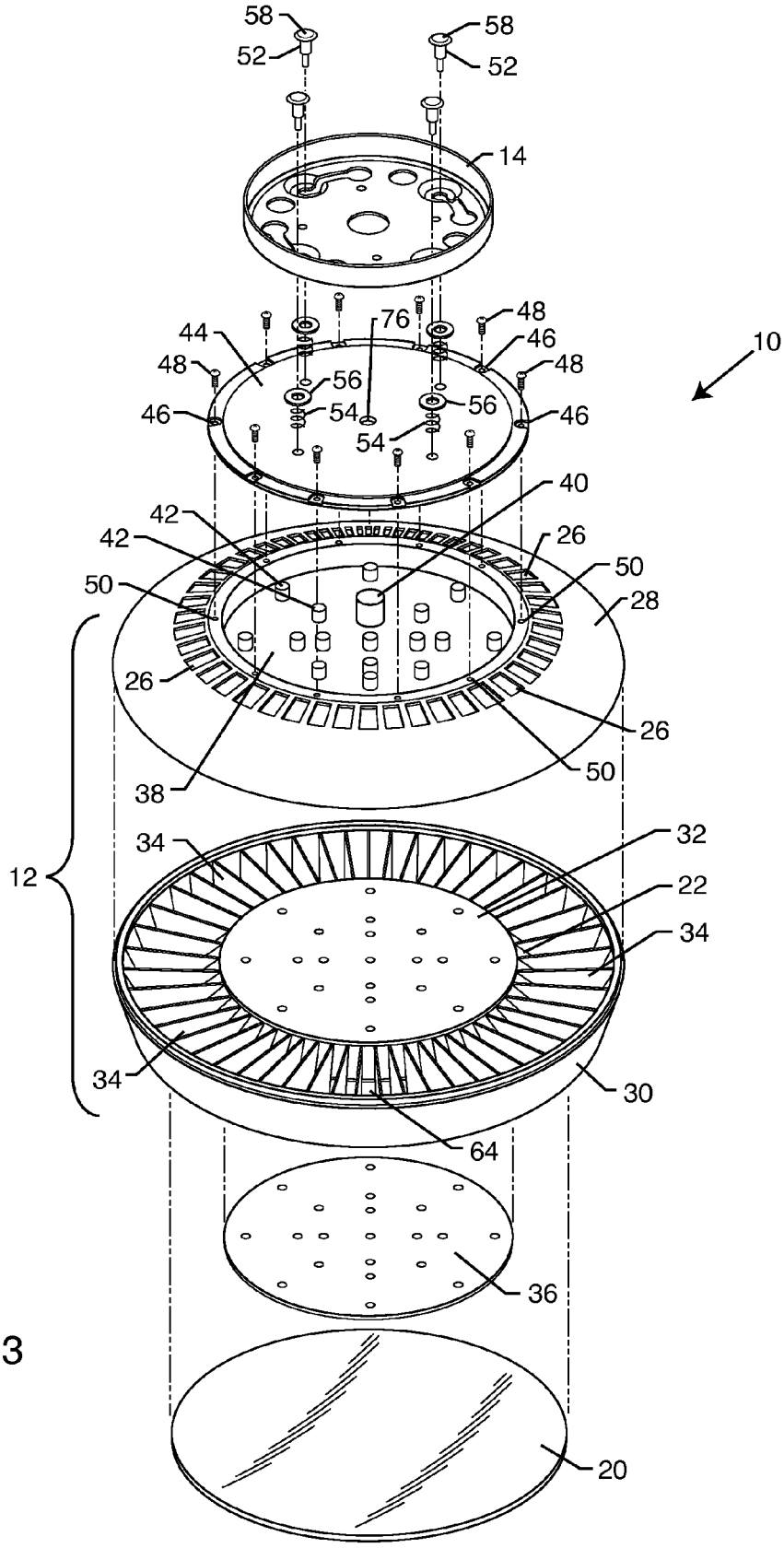
FIG. 3 is an exploded perspective view of the industrial light embodying the improved heat sink system.

FIG. 3 is an exploded perspective view of the industrial light 10. The outer heat sink 12 is illustrated split into an upper heat sink 28 and a lower heat sink 30. The lower heat sink 30 has a conductive mount 32 positioned central to a plurality of lower cooling fins 34 biased between the inner heat sink 22 and the lower heat sink 30. Preferably, the conductive mount 32 conductively couples to the lower cooling fins 34 via the inner heat sink 22. A heat generating device 36, in this case a PCB board 36 having a plurality of high brightness LED chips surface mounted therein, attaches to the conductive mount 32 by any means known in the art. For example, the PCT board 36 may be soldered to the conductive mount 32 by a highly conductive metal material such as tin. Alternatively, the PCB board 36 may mechanically attach to the conductive mount 32 by clips, snaps or another attachment mechanism known in the art. In this embodiment, it may be preferable to dispose a conductive material between the planar portion of the conductive mount 32 and the PCB board 36 to increase the efficiency of heat transfer between the two components. One particularly preferred material may include the thermal compounds commonly used between computer chips and their heat sinks. One particularly preferred feature of the industrial light 10 is that the planar portion of the PCB board 36 abuts the planar portion of the conductive mount 32 thereby increasing the surface area contact therebetween. The light diffuser 20 extends up into and attaches to the lower heat sink 30 to encapsulate the PCB board 36 within the interior of the industrial light 10, as described in more detail below with respect to FIG. 6.

The upper heat sink 28 includes a chamber 38 that houses various electrical components, including a power supply 40. The power supply 40 is preferably an integrated high efficiency LED driver power supply. Such a power supply 40 has a power factor (PFC)>0.94 and has 90% efficiency. A smart circuitry (not numbered) integral to the power supply 40 preferably includes 6000 VAC surge and transient voltage protection to prevent the electrical components from being damaged in the event of an electrical spike. The current should be precisely controlled to make sure it stays constant so that the power source 40 remains stable. The chamber 38 provides space for electrical components such as the power supply 40, circuits and other similar devices that operate the industrial light 10. The chamber 38 also provides room to wire these devices to the power supply 40 for operating the industrial light 10. For example, the chamber 38 may house a plurality of LED connections 42 that protrude out from the PCB board 36, through the conductive mount 32 and into the chamber 38 for connection to the power supply 40. The chamber 38 is preferably environmentally sealed, such as by a cap 44. In the embodiment shown in FIG. 3, the cap 44 includes a plurality of apertures 46 around its exterior circumference that each selectively receives a screw 48. A plurality of threaded apertures 50 are disposed around the internal circumference of the upper heat sink 28 between the chamber 38 and the vents 26. The screws 48 extend through the respective apertures 46 to screwingly engage the threaded apertures 50 to securely attach the cap 44 to the upper heat sink 28. An O-ring (not shown), sealant or other adhesive may be disposed between the cap 44 and the upper heat sink 28 to ensure that the chamber 38 is sealed from the exterior environment.

Moreover, the cap 44 further includes a plurality of pins 52 threadingly engaged thereto. A set of respective springs 54 bias a washer 56 toward a head portion 58 of the pins 52. The pins 52, the springs 54 and the washers 56 cooperate with one another to selectively engage the mounting bracket 14. This enables a user to selectively engage the cap 44 with the mounting bracket 14 by utilizing the snap and turn mounting mechanism described below with respect to FIGS. 9-11.

Figure 4:
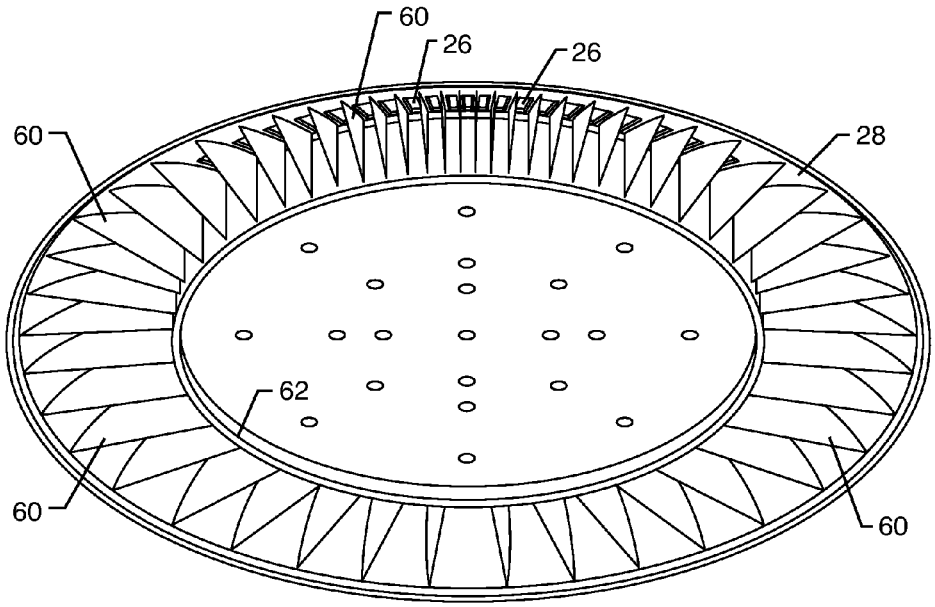
FIG. 4 is a bottom perspective view of an upper heat sink as described herein.
Figure 5:
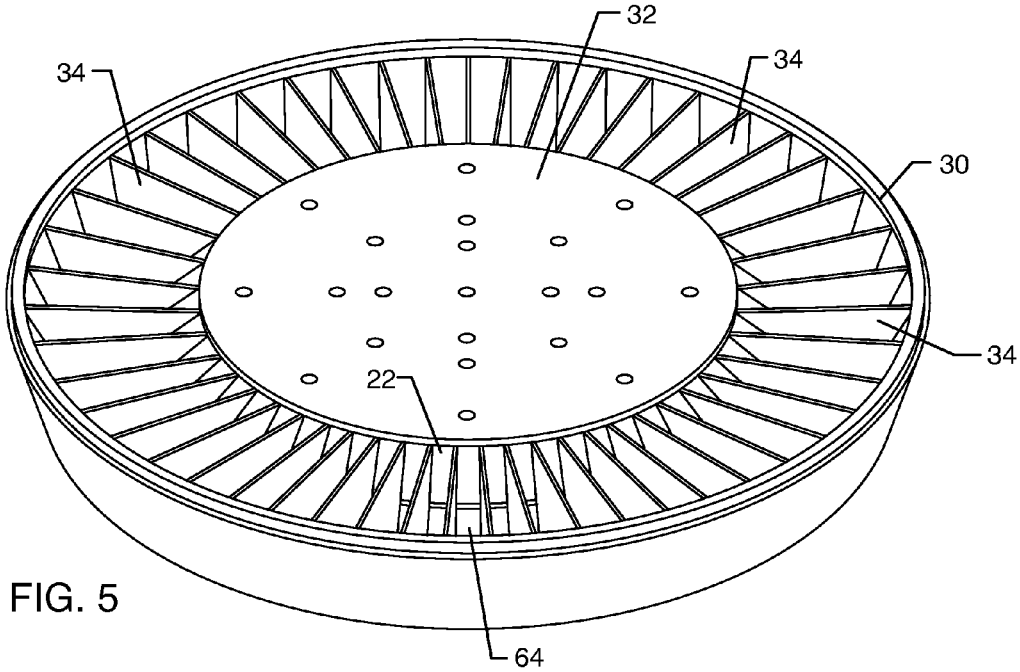
FIG. 5 is a top perspective view of a lower heat sink as described herein.

FIGS. 4 and 5 illustrate the interior of the upper heat sink 28 and the lower heat sink 30, respectively. Preferably, the upper heat sink 28 engages the lower heat sink 30 through some mechanical or adhesive connection mechanism that ensures that the two heat sinks 28, 30 remain environmentally sealed to one another. For example, the upper heat sink 28 may snap into the lower heat sink 30 along an external rib or snap mount-type mechanism. Alternatively, an adhesive may be disposed around the exterior perimeter of the upper and lower heat sinks 28, 30 to permanently or removably attach the two heat sinks 28, 30. In some embodiments it may be preferable that the upper heat sink 28 remain permanently adhered to or otherwise sealed to the lower heat sink 30. In other circumstances, it may be desirable such that the upper heat sink 28 is selectively disengageable from the lower heat sink 30 so that a user may access the internal portion of the industrial light 10. In this embodiment, the upper heat sink 28 should still be sealable to the lower heat sink 30, such as by use of an O-ring or other similar device.

Figure 7:
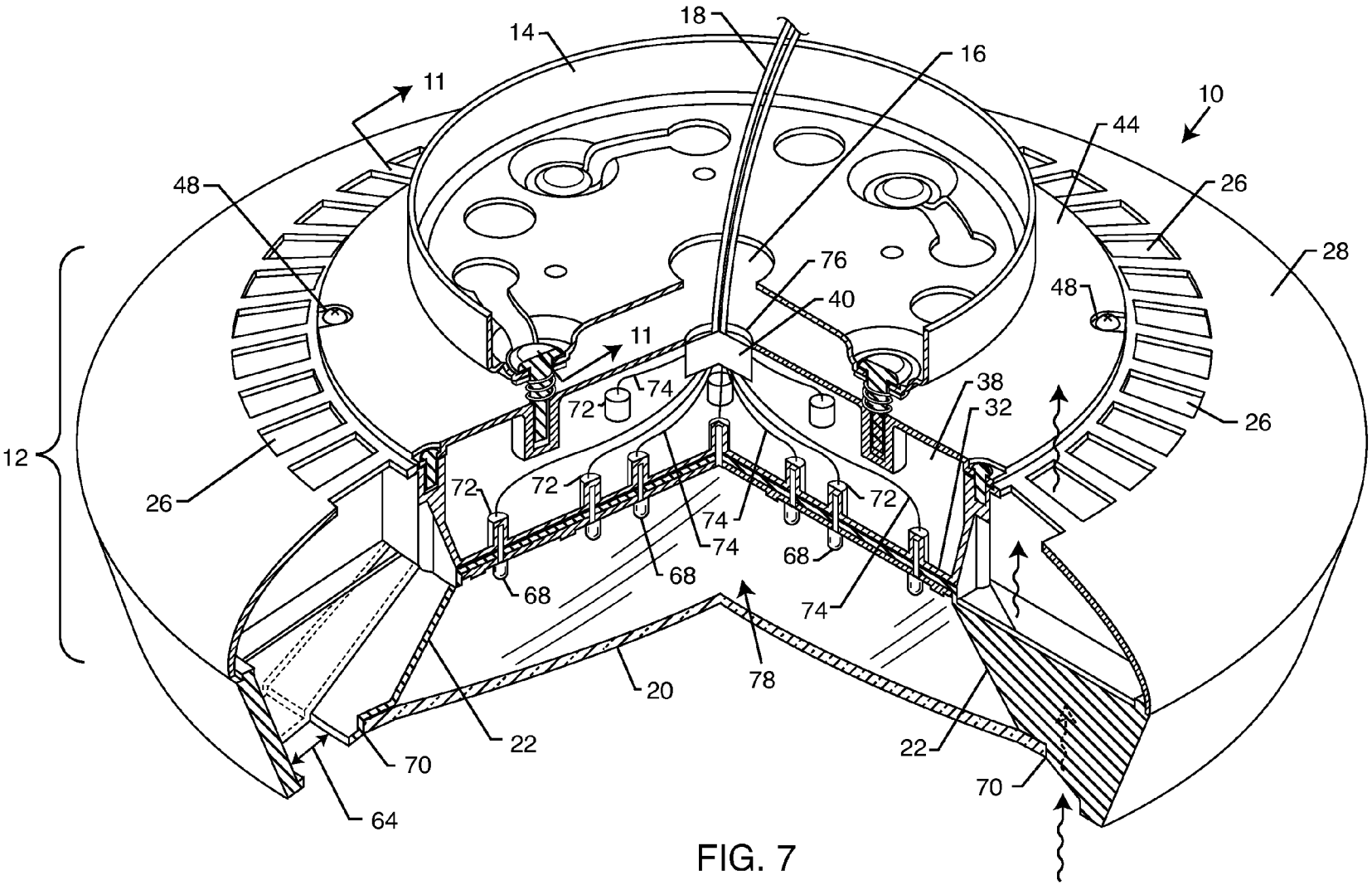
FIG. 7 is a partial cut-away perspective view taken along the line 7-7 in FIG. 1, illustrating the industrial light embodying the improved heat sink system and including a snap and turn mounting system.

One particular aspect of the upper heat sink 28 and the lower heat sink 30 shown in FIGS. 4 and 5 is that each heat sink 28, 30 includes its own set of cooling fins 24—i.e. the upper heat sink 28 includes a plurality of upper cooling fins 60 while the lower heat sink 30 includes its own set of lower cooling fins 34. With respect to FIG. 4, the upper heat sink 28 includes an inner vertical ring 62 that, in part, forms the aforementioned chamber 38 between the conductive mount 32 and the generally arcuate outer surface of the upper heat sink 28. The upper cooling fins 60 extend from this vertically extending inner ring 62 to the exterior circumference of the upper heat sink 28. The outer exterior surface of the upper heat sink 28 is curved as shown in FIGS. 1, 3 and 7. Thus, the upper cooling fins 60 tend to follow the curvature of the outer surface of the upper heat sink 28. Even though the upper heat sink 28 and the matching lower heat sink 30 are circular and generally arcuate, a person of ordinary skill in the art will readily recognize that the heat sinks 28, 30 could be made out of any shape, size or configuration. The purpose of positioning the upper cooling fins 60 between the inner ring 62 and the outer surface area of the upper heat sink 28 is to maximize the surface area therein. These features enhance the heat dissipation efficiency of the improved heat sink system of the industrial light 10 described herein. Each of the upper cooling fins 60 are preferably positioned intermediate to the vents 26 to ensure efficient air flow through the outer heat sink 12 and across the surface area of all the aforementioned cooling fins 24.

The lower heat sink 30 is configured similarly to the upper heat sink 28. In this regard, the plurality of lower cooling fins 34 extend between the inner heat sink 22 and the lower heat sink 30. The inner heat sink 22 is conductively coupled to the conductive mount 32 and extends outwardly therefrom at an angle as shown in FIGS. 5 and 7. One feature of the improved heat sink system described herein is that the inner heat sink 22 only extends partially between the conductive mount 32 and the exterior of the lower heat sink 30. As shown in more detail with respect to FIG. 6, this enables the light diffuser 20 to secure up into and abut the outer portion of the inner heat sink 22 to encapsulate the PCB board 36 within the interior of the industrial light 10. This ensures that the LEDs and related circuitry are not exposed to the external environment. Isolating the internal circuitry allows the body/housing of the industrial light 10—i.e. the improved heat sink system—to operate as the heat sink itself. Furthermore, this ensures that the heat dissipation properties of the improved heat sink are not sacrificed. FIG. 2 more specifically illustrates the termination of the inner heat sink 22 along the exterior circumference of the light diffuser 20. The diameter of the light diffuser 20 and the inner heat sink 22 is smaller than the diameter of the lower heat sink 30. Thus, a gap 64 exists between the inner heat sink 22 and the lower heat sink 30. As best shown in FIG. 7, the gaps 64 permit air to flow over the lower heat sink 22, the lower cooling fins 34 and up through the upper heat sink 28 and the upper cooling fins 60. Air is allowed to exit through the top of the industrial light 10 through the vents 26. Placing the plurality of cooling fins 24 three hundred sixty degrees around the exterior of the heat generating device 36 increases the available heat dissipating surface area subject to air flow therethrough via the vents 26 in the upper heat sink 28 and the gaps 64 in the lower heat sink 30. This maximizes the air convection on an increased surface area around the heat generating device 36. External radiator light ribs are no longer needed. Thus, the potential for the industrial light 10 to collect dust and dirt that reduces/chokes air convection and cooling in traditional systems is greatly reduced.

Figure 6:
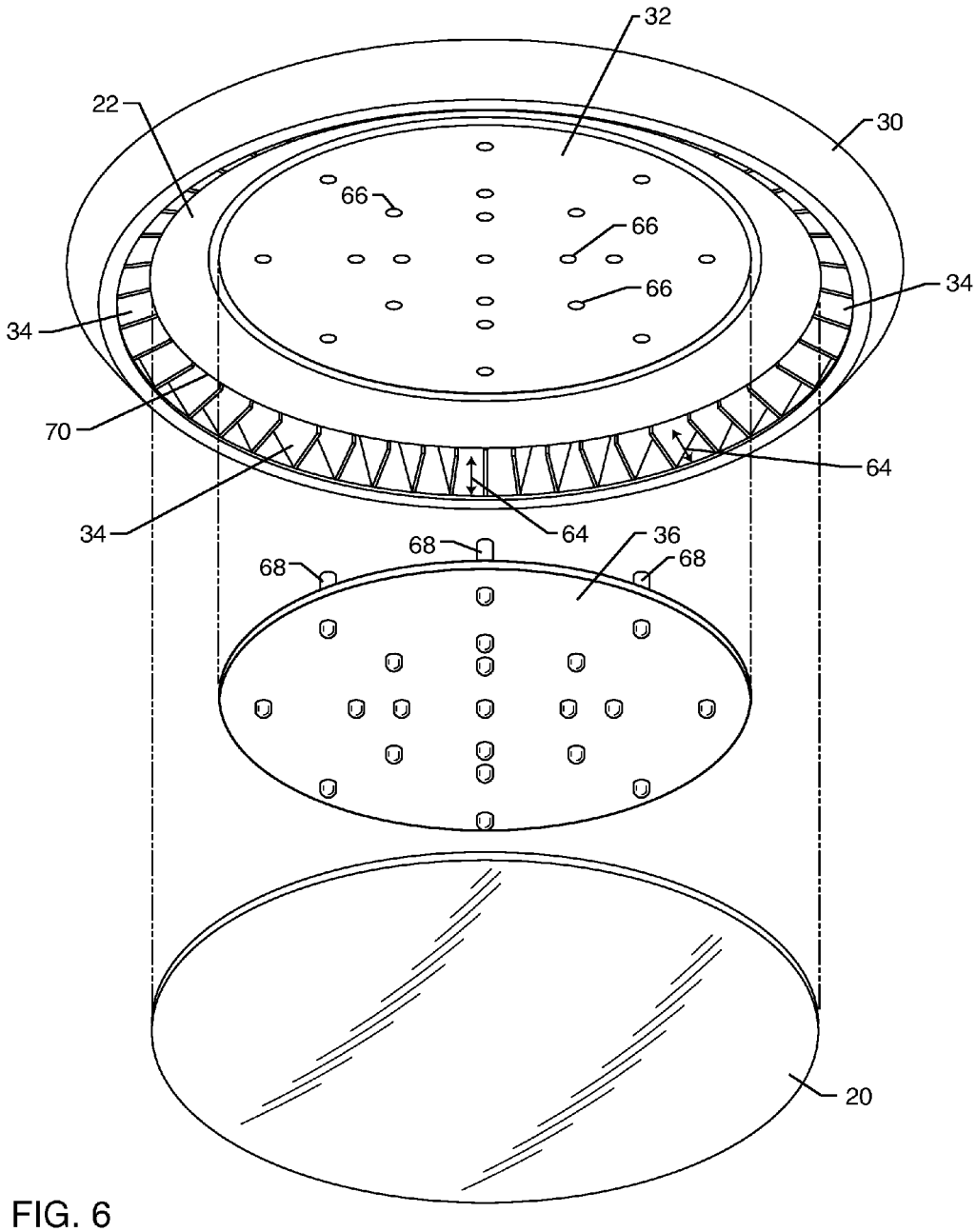
FIG. 6 is a partial bottom exploded perspective view illustrating attachment of a PCB board having a plurality of LEDs therein to a conductive mount integral to the improved heat sink.

FIG. 6 is an exploded perspective view that illustrates how the PCB board 36 is encapsulated within the interior of the lower heat sink 30 by the light diffuser 20 and the inner heat sink 22. The conductive mount 32 includes a plurality of apertures 66 that allow portions of the plurality of surface mount LEDs 68 to extend therethrough. For the most part, the planar surface of the PCB board 36 is placed adjacent to and abuts the conductive mount 32. Heat generated by the LEDs 68 immediately conducts back into the conductive mount 32. Such conduction draws heat away from the heat generating device, in this case the PCB board 36, to ensure the longevity of the LEDs 68. The inner heat sink 22 extends outwardly from the conductive mount 32 and terminates at an outer edge 70. The inner heat sink 22 is positioned to encompass the PCB board 36 such that its surface area is subject to outwardly expanding heat generated by the PCB board 36 and the LED 68. This heat is transferred to the inner heat sink 22 and the lower cooling fins 34. Each of the lower cooling fins 34 follows the contour of the inner heat sink 22 to the termination edge 70. From there, the lower cooling fins 34 extend out to the interior of the lower heat sink 30, thereby forming the gaps 64 between the outer edge 70 of the inner heat sink 22 and the exterior of the lower heat sink 30. Air is allowed to flow through the gaps 64 and adjacent to the lower cooling fins 34 and the inner heat sink 22 while the LEDs 68 surface mounted to the PCB board 36 remain sealed from the environment. The circumferential gaps 64 act as air vents that allow air convection cooling of the various surface areas thereof to create a better heat dissipation system. The key is that heat is always drawn away from the heat generating device 36. Lower temperatures at the PCB board 36 generally increase the life and output of the LEDs 68.

FIG. 7 is a partial cut-away of the industrial light 10 as described herein. FIG. 7 illustrates the generally arcuate upper heat sink 28 attached to the cap 44 by the screws 48. Connection of the cap 44 to the upper heat sink 28 forms the chamber 38 therebetween. The chamber 38 houses various electrical components, including a set of electrical connectors 72 for each of the LEDs 68. The electrical connectors 72 receive an electrical wire 74 that couples the LEDs 68 to the power supply 40 and other electronic equipment, such as a safety controlled smart circuitry. Such circuitry includes an over temperature production sensor, an over voltage protection sensor and an over current protection sensor. Each of these sensors are coupled to a kill switch that shuts off or reduces power output from the power supply 40 to the LEDs 68 in the event that the temperature protection sensor determines a threshold temperature has been exceeded, the voltage protection sensor determines that a voltage threshold has been exceeded, or the current protection sensor determines that a current threshold has been exceeded. It is important to reduce the temperature at the electrical connectors 72 to ensure that the LEDs 68 retain a maximum operating lifespan. This is accomplished through implementation of the improved heat sink system described herein such that a high powered lighting unit that utilizes the aforementioned LEDs 68 can be used in environments exceeding 50° C. The electrical wires 18 extend out from the power supply 40, through a central aperture 76 in the cap 44 and out through the central aperture 16 in the mounting bracket 14. The central apertures 16, 76 allow the industrial light 10 to rotate relative to the mounting bracket 14 without any of the electrical wires 18, 74 or the electrical connectors 72 from twisting, binding or otherwise catching on any of the components described herein.

FIG. 7 also illustrates the connection of the inner heat sink 22 to the conductive mount 32 and to the light diffuser 20 along the edge 70. The inner heat sink 22 generally extends out and away from the conductive mount 32 at the angle shown. The light diffuser 20 connects to the inner heat sink 22 along the outer edge 70 thereof. Light generated by the LEDs 68 enters the interior of the industrial light 10 formed by the conductive mount 32, the inner heat sink 22 and the light diffuser 20. The interior surface area of the light diffuser 20, the inner heat sink 22 and the conductive mount 32 (which is partially obstructed by the PCB board 36 attached thereto) forms an enclosure 78 environmentally sealed to protect the integrity of the LEDs 68 from weather conditions or other environmental factors that may decrease the life span of the LEDs 68. At the same time, air is allowed to flow between the outside surface area of the inner heat sink 22 and the interior surface area of the outer heat sink 12. Exemplary air flow is designated by the directional arrows shown in FIG. 7. Specifically, air flow may enter between the inner heat sink 22 and the outer heat sink 12 through the gaps 64. Air flow then passes adjacent to the interior surface area of both the lower and upper heat sinks 28, 30, past the cooling fins 24 and out through the vents 26 in the upper heat sink 28. The air flow sequence may also be reversed depending on deployment of the improved heat sink system and/or the industrial light 10 described herein. Either way, the important aspect is that air flow is able to move through a larger surface area through deployment of the outer heat sink 12 coupled to the inner heat sink 22 via the plurality of cooling fins 24. Additionally, this design provides such enhanced air flow and heat dissipation while simultaneously encapsulating the heat generating device 36 (in this case the PCB board 36) from adverse environmental conditions that may shorten the life of the device 36, including, for example, the LEDs 68. Thus, cooling by air convection takes place at a higher rate compared to traditional heat sinks. This occurs because other traditional heat sinks have similar ribs/membranes without the outer heat sink 12 and the vents 26, which eliminates any air flow therebetween and decreases available surface area, thereby significantly reducing air convection.

Figure 8:
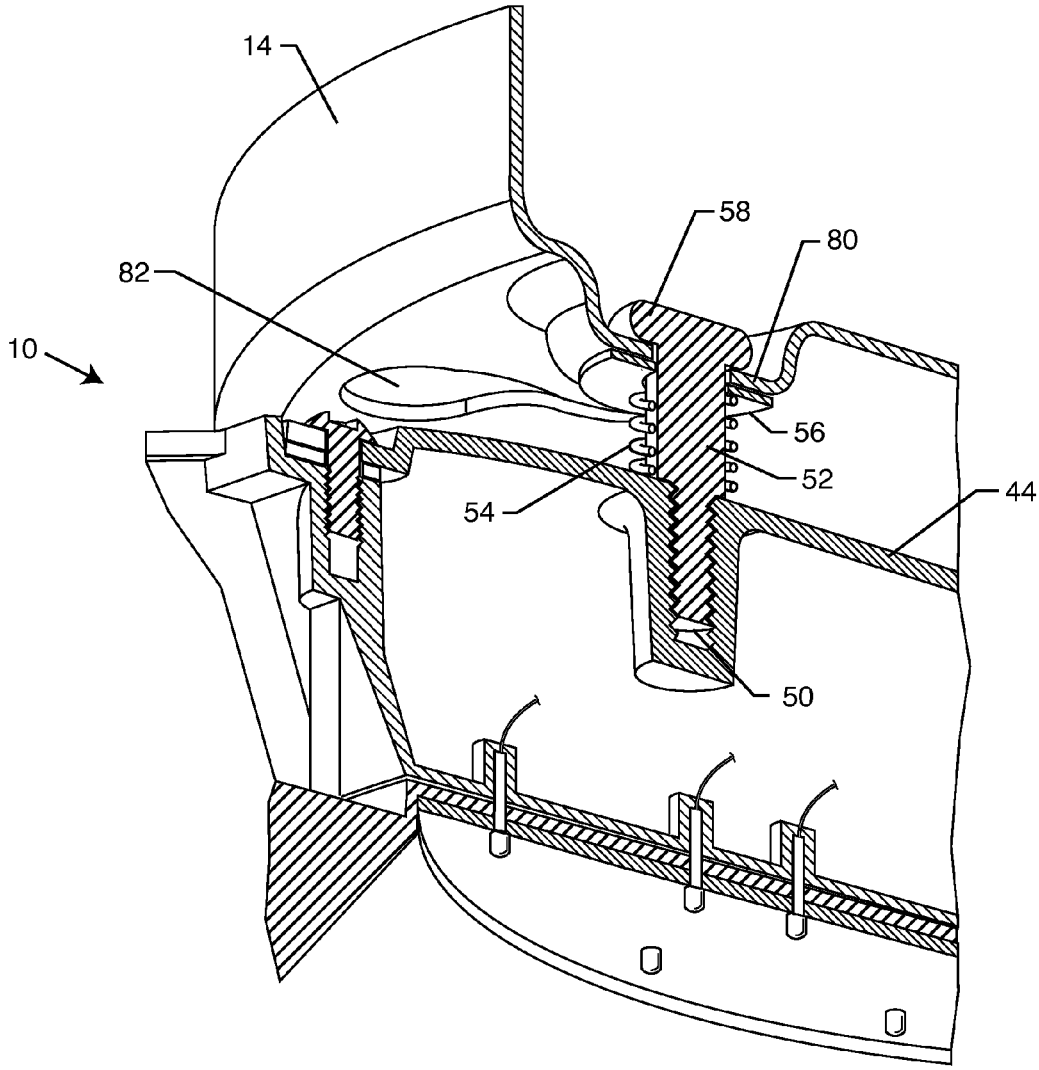
FIG. 8 is an enlarged cut-away perspective view of the PCB board attached to the conductive mount and the industrial light engaged with the snap and turn mounting system.

A portion of the snap and turn mounting system is shown generally in FIG. 8. First, the mounting bracket 14 is screwed into a ceiling or attached to another component that will retain the industrial light 10. In general, FIG. 8 is an enlarged cut out view illustrating the pin 52 engaged to the cap 44 via the threaded aperture 50. The pin 52 is shown secured to the mounting bracket 14. The coil spring 54 biases the washer 56 against a flange 80 of the mounting bracket 14 engaged on the other end by the head 58 of the pin 52.

Figure 9:
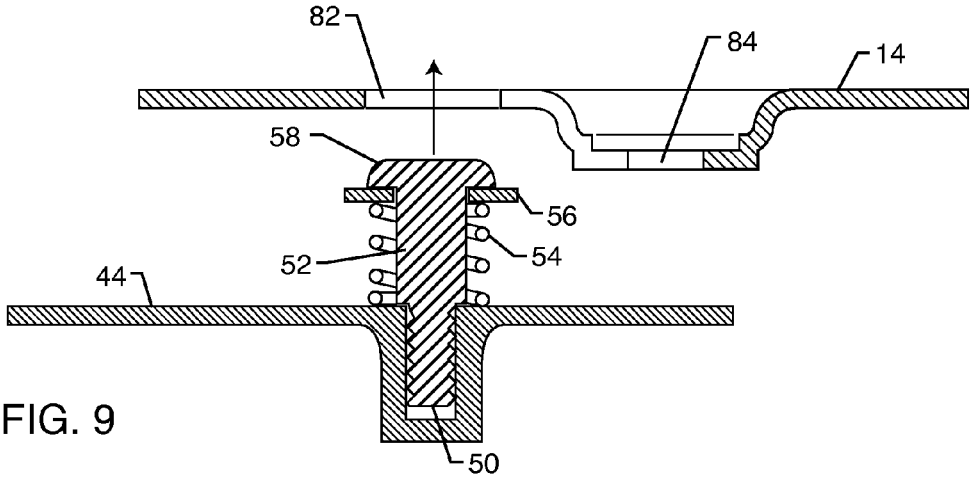
FIG. 9 is a partial cross-sectional view based on the section 11-11 in FIG. 7, illustrating a mounting pin extending from the industrial light and positioned to engage the snap and turn mounting system.
Figure 10:
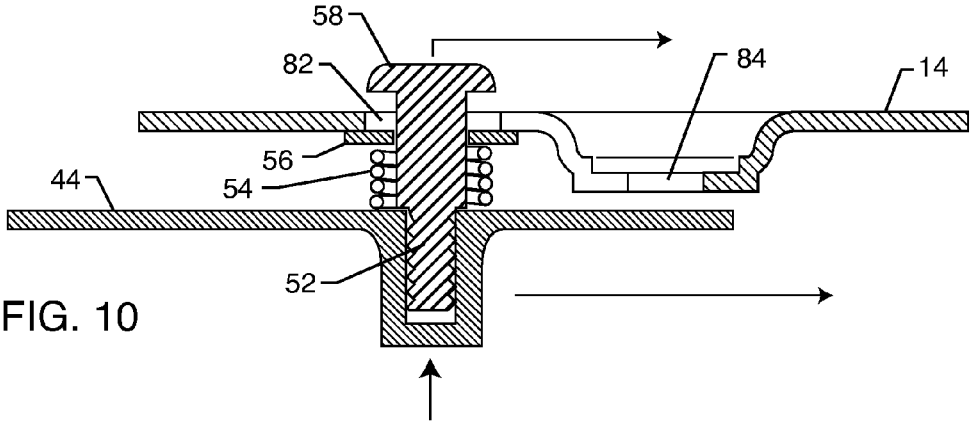
FIG. 10 is a partial cross-sectional view based on the section 11-11 in FIG. 7, illustrating the mounting pin extending through the mounting bracket and biased therein by a spring tensioned washer.
Figure 11:
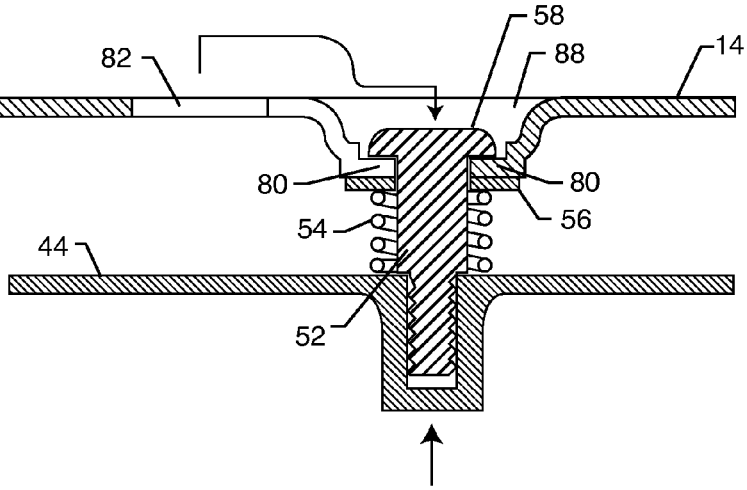
FIG. 11 is a partial cross-sectional view taken about the line 11-11 in FIG. 7, illustrating engagement of the pin with the mounting bracket and biased therebetween with the spring tensioned washer.

FIG. 9 more specifically illustrates the pin 52 mounted to the threaded aperture 50 of the cap 44. Here, the mounting bracket 14 has been pre-attached to a surface or an object to which the industrial light 10 is to be used. As shown in FIG. 9, the spring 54 biases the washer 56 underneath the head 58 of the pin 52 with minimal pressure. The spring 54 applies constant pressure to the washer 56 such that the washer 56 remains flush against the head 58 of the pin 52 when the industrial light 10 is disengaged from the mounting bracket 14. The head 58 is sized to fit through an engagement aperture 82 (also shown in FIG. 8) in the mounting bracket 14. To do so, the user pushes the industrial light 10 up into the mounting bracket 14 as best shown in FIG. 10. The outer diameter of the head 58 fits through the engagement aperture 82 of the mounting bracket 14, but the outer diameter of the washer 56 is wider than the engagement aperture 82 and catches on the surface thereof. The washer 56 moves longitudinally along the length of the pin 52 compressing the coil spring 54 as shown in FIG. 10 relative to FIG. 9. This enables a user to effectively push the head 58 through the mounting bracket 14 for eventual engagement in a retainment aperture 84. Once the head 58 extends through the width of the mounting bracket 14, a user may twist or turn the industrial light 10 in a circular or linear pattern such that the body of the pin 52 engages the respective snap and turn channels 86 best shown in FIG. 1. The channels 86 are sized to facilitate the width of the body of the pin 52 while being smaller than the diameter of the head 58 and the washers 56. Continuing to rotate the industrial light 10 eventually causes the pin 52 to enter within a pocket 88 formed into the surface of the mounting bracket 14. The retainment aperture 84 within the pocket 88 has a diameter that is approximately the diameter of the width of the pin 52. Thus, the larger width head 58 engages the flanges 80 as shown in FIG. 11. Once the user releases the industrial light 10, the coil spring 54 extends upwardly to engage the washer 56 underneath the flanges 80. Accordingly, the head 58 and the washer 56 sandwich the flanges 80 therebetween to secure the pin 52 in the retainment aperture 84 of the pocket 88. The pocket 88 is recessed from the general planar portion of the mounting bracket 14 to ensure that the locking pin 52 remains securely therein. This prevents the pin 52 from sliding or rotating back out of the retainment aperture 84 from vibration, wind or other similar movements. To remove the industrial light 10, a user need only apply pressure along the arrow shown in FIG. 11 to pop out the head 58 from within the interior of the pocket 88 to enable sliding movement back through the channels 86 such that the head 58 is realigned with the engagement aperture 82 for removal out from within the mounting bracket 14.

Figure 12:
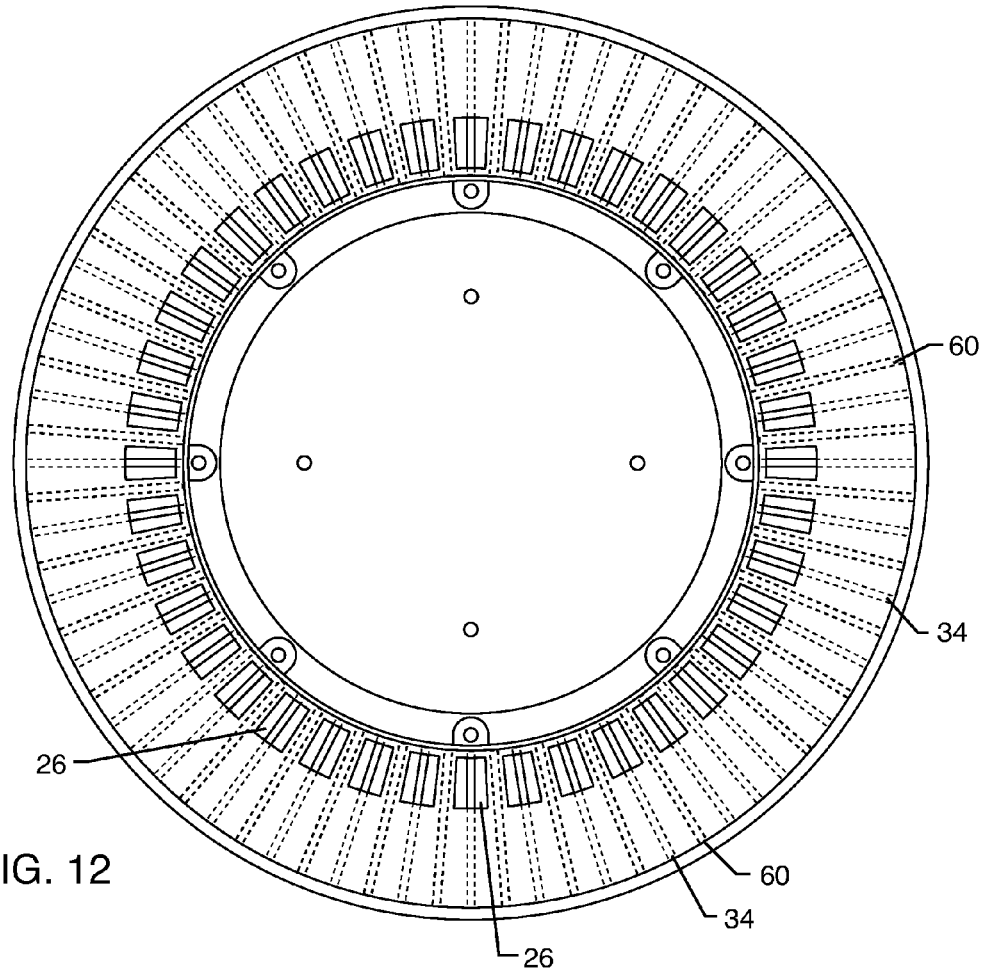
FIG. 12 is a top planar view of the industrial light, illustrating the positioning of the plurality of cooling fins extending between the upper and lower heat sinks.
Figure 13:
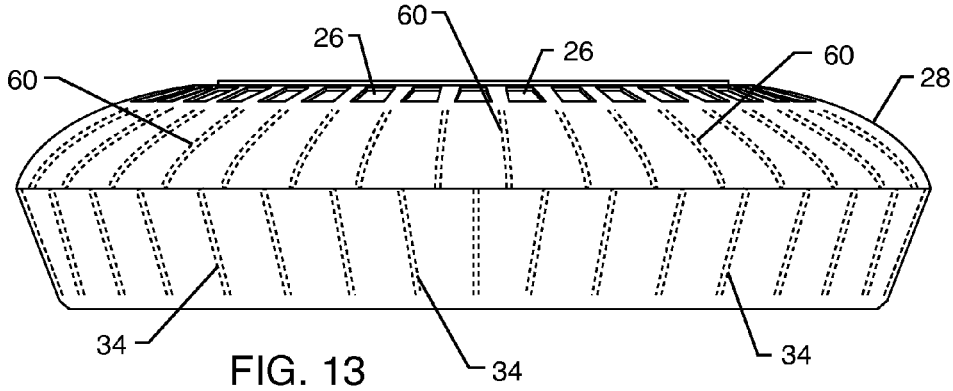
FIG. 13 is a side view of the industrial light further illustrating the offset positioning of the upper and lower cooling fins.

Furthermore, FIGS. 12 and 13 illustrate the arrangement of the upper cooling fins 60 and the lower cooling fins 34. Preferably, the lower cooling fins 34 are offset from the upper cooling fins 60 as generally illustrated in FIG. 13. It is also preferable that the upper cooling fins 60 be offset from the plurality of vents 26 in the upper heat sink 28. As such, the lower cooling fins 34 may be aligned with the vents 26 as shown by the solid lines in FIG. 12. The offsetting nature of the lower cooling fins 34 from the upper cooling fins 60 is designed to enhance the heat dissipating surface area subject to air convection to increase the cooling efficiency of the isolated heat sink system. These features maximize air convection on the effective surface areas around the heat generating device 36 to increase the efficiency of dissipating heat from the source to the external environment. As heat is generated by the PCB board 36, it is transferred to the offset lower cooling fins 34 and the upper cooling fins 60 via the conductive mount 32 and the inner heat sink 22. Positioning the cooling fins 34 three hundred sixty degrees around the exterior of the heat generating device 36 further maximizes the heat dissipation qualities of the improved heat sink system.

Although several embodiments have been described in detail for purposes of illustration, various modifications may be made to each without departing from the scope and spirit of the invention. Accordingly, the invention is not to be limited, except as by the appended claims.

What is claimed is:

1. An improved heat sink system for a lighting fixture, comprising:

a conductive mount configured to selectively receive and retain a lighting subassembly;

an inner heat sink coupled to the conductive mount and positioned to encompass the lighting subassembly;

a plurality of cooling fins coupled to and extending away from the inner heat sink; and an outer heat sink coupled to the cooling fins and offset from the inner heat sink to permit airflow therebetween and over the cooling fins such that air convection cooling of the inner heat sink, the outer heat sink and the cooling fins draws heat energy away from the lighting subassembly, wherein the outer heat sink comprises a lower heat sink coupled to a first set of cooling fins mounted to the inner heat sink and an upper heat sink coupled to a second set of cooling fins offset from the first set of cooling fins.

2. The heat sink of claim 1, wherein the lighting subassembly includes a plurality of LEDs electrically coupled to a PCB board attachable to the conductive mount.

3. The heat sink of claim 2, wherein each LED comprises a high brightness LED chip surface mounted to the PCB board.

4. The heat sink of claim 1, including a cap coupled to the inner heat sink to environmentally encapsulate the lighting subassembly.

5. The heat sink of claim 4, wherein the cap comprises a reflector.

6. The heat sink of claim 5, wherein the reflector comprises a light dispersing lens having an optical diffuser surface area providing no glare uniform lighting.

7. The heat sink of claim 1, including an air vent extending through the outer heat sink to permit airflow adjacent to the cooling fins and the inner heat sink.

8. The heat sink of claim 1, including a safety circuit coupled to the lighting subassembly and including a temperature sensor, a voltage sensor or a current sensor.

9. The heat sink of claim 8, including a kill switch operated by the safety circuit that automatically activates when the temperature sensor determines a threshold temperature has been exceeded, the voltage sensor determines a threshold voltage has been exceeded, or the current sensor determines that a threshold current has been exceeded.

10. The heat sink of claim 1, wherein the conductive mount, the inner heat sink and the outer heat sink comprise a highly conductive alloy metal or a die-cast material.

11. The heat sink of claim 1, wherein the surface area of the outer heat sink is relatively larger than the surface area of the inner heat sink.

12. An improved heat sink system for a lighting fixture, comprising:

a conductive mount configured to selectively receive and retain a lighting subassembly having a plurality of LEDs electrically coupled to a PCB board attachable to the conductive mount;

an inner heat sink coupled to the conductive mount and positioned to encompass the lighting subassembly;

a plurality of cooling fins coupled to and extending away from the inner heat sink;

an outer heat sink coupled to the cooling fins and offset from the inner heat sink to permit airflow therebetween and over the cooling fins such that air convection cooling of the inner heat sink, the outer heat sink and the cooling fins draws heat energy away from the lighting subassembly, wherein the outer heat sink comprises a lower heat sink coupled to a first set of cooling fins mounted to the inner heat sink and an upper heat sink coupled to a second set of cooling fins offset from the first set of cooling fins;

a reflector coupled to the inner heat sink to environmentally encapsulate the lighting subassembly; and a safety circuit coupled to the lighting subassembly and including a temperature sensor, a voltage sensor or a current sensor.

13. The heat sink of claim 12, wherein each LED comprises a high brightness LED chip surface mounted to the PCB board and the reflector comprises a light dispersing lens having an optical diffuser surface area providing no glare uniform lighting.

14. The heat sink of claim 12, including an air vent extending through the outer heat sink to permit airflow adjacent to the cooling fins and the inner heat sink and a kill switch operated by the safety circuit that automatically activates when the temperature sensor determines a threshold temperature has been exceeded, the voltage sensor determines a threshold voltage has been exceeded, or the current sensor determines that a threshold current has been exceeded.

15. The heat sink of claim 12, wherein the conductive mount, the inner heat sink and the outer heat sink comprise a highly conductive alloy metal or a die-cast material and the surface area of the outer heat sink is relatively larger than the surface area of the inner heat sink.

16. An improved heat sink system for a lighting fixture, comprising:

a conductive mount configured to selectively receive and retain a lighting subassembly having a plurality of LEDs electrically coupled to a PCB board attachable to the conductive mount, wherein each LED comprises a high brightness LED chip surface mounted to the PCB board;

an inner heat sink coupled to the conductive mount and positioned to encompass the lighting subassembly;

a plurality of cooling fins coupled to and extending away from the inner heat sink;

an outer heat sink coupled to the cooling fins and offset from the inner heat sink to permit airflow therebetween and over the cooling fins such that air convection cooling of the inner heat sink, the outer heat sink and the cooling fins draws heat energy away from the lighting subassembly, wherein the outer heat sink comprises a lower heat sink coupled to a first set of cooling fins mounted to the inner heat sink and an upper heat sink coupled to a second set of cooling fins offset from the first set of cooling fins;

a cap coupled to the inner heat sink to environmentally encapsulate the lighting subassembly, wherein the cap comprises a light dispersing lens having an optical diffuser surface area providing no dare uniform lighting;

a safety circuit coupled to the lighting subassembly and including a temperature sensor, a voltage sensor or a current sensor; and a kill switch operated by the safety circuit that automatically activates when the temperature sensor determines a threshold temperature has been exceeded, the voltage sensor determines a threshold voltage has been exceeded, or the current sensor determines that a threshold current has been exceeded.

17. The heat sink of claim 16, including an air vent extending through the outer heat sink to permit airflow adjacent to the cooling fins and the inner heat sink, wherein the conductive mount, the inner heat sink and the outer heat sink comprise a highly conductive alloy metal or a die-cast material and the surface area of the outer heat sink is relatively larger than the surface area of the inner heat sink.

* * * * *

UNITED STATES PATENT AND TRADEMARK OFFICE

CERTIFICATE OF CORRECTION

PATENT NO. : 8,272,765 B2
APPLICATION NO. : 12/819572
DATED : September 25, 2012
INVENTOR(S) : Zorak Ter-Hovhannisyan It is certified that error appears in the above-identified patent and that said Letters Patent is hereby corrected as shown below:

In column 12, line 19 (claim 16), replace “dare” with -- glare --.

Signed and Sealed this
Twenty-ninth Day of January, 2013

David J. Kappos

David J. Kappos
*Director of the United States Patent and Trademark Office*